US009045942B2

(12) United States Patent
Gillis

(10) Patent No.: US 9,045,942 B2
(45) Date of Patent: Jun. 2, 2015

(54) DOWNHOLE MOTOR ASSEMBLY

(75) Inventor: Sean Gillis, Beaumont (CA)

(73) Assignee: Drilformance Technologies, LLC, Houston, TX (US)

( * ) Notice: Subject to any disclaimer, the term of this patent is extended or adjusted under 35 U.S.C. 154(b) by 290 days.

(21) Appl. No.: 13/530,870

(22) Filed: Jun. 22, 2012

(65) Prior Publication Data

US 2013/0341099 A1 Dec. 26, 2013

(30) Foreign Application Priority Data

Jun. 20, 2012 (CA) ..... 2780515

(51) Int. Cl.
*E21B 4/02* (2006.01)
*E21B 4/00* (2006.01)

(52) U.S. Cl.
CPC .. *E21B 4/003* (2013.01); *E21B 4/02* (2013.01)

(58) Field of Classification Search
CPC ..... E21B 4/02; E21B 17/076; E21B 4/006; E21B 17/07
USPC ..... 175/92, 101, 107, 321
See application file for complete search history.

(56) References Cited

U.S. PATENT DOCUMENTS

| | | | | |
|---|---|---|---|---|
| 4,232,751 | A * | 11/1980 | Trzeciak | 175/101 |
| 6,629,571 | B1 | 10/2003 | Downie | |
| 7,416,034 | B2 | 8/2008 | Downie et al. | |
| 7,802,638 | B2 | 9/2010 | Downie et al. | |
| 2004/0026129 | A1* | 2/2004 | Downie et al. | 175/106 |
| 2008/0264693 | A1* | 10/2008 | Downie et al. | 175/106 |
| 2011/0129375 | A1 | 6/2011 | Kotsonis | |
| 2011/0147091 | A1 | 6/2011 | Bullin | |
| 2012/0205158 | A1* | 8/2012 | Barnes et al. | 175/57 |
| 2014/0332275 | A1 | 11/2014 | Murray et al. | |

FOREIGN PATENT DOCUMENTS

| | | |
|---|---|---|
| EP | 1406016 | 4/2004 |

* cited by examiner

*Primary Examiner* — Blake Michener
(74) *Attorney, Agent, or Firm* — Terrence N. Kuharchuk; Rodman & Rodman

(57) ABSTRACT

A downhole motor assembly which has a housing, a power section with a stator and a rotor contained within the housing. A proximal drive assembly is connected with a proximal rotor end, a distal drive assembly is connected with a distal rotor end, and a proximal thrust bearing is arranged between the housing of the proximal drive assembly. A distal thrust bearing is arranged between the housing and the distal drive assembly. An axial load decoupling device is in the distal drive assembly located longitudinally between the distal rotor end and the distal thrust bearing, and is used for separating axial loads imposed on the proximal thrust bearing from axial loads imposed on the distal thrust bearing.

25 Claims, 3 Drawing Sheets

DOWNHOLE MOTOR ASSEMBLY

TECHNICAL FIELD

A downhole motor assembly for use in drilling subterranean boreholes.

BACKGROUND OF THE INVENTION

Subterranean boreholes are typically drilled using a drill string which includes drill pipe or coiled tubing, with a drill bit connected at the distal end of the drill string.

The drill bit may be rotated by rotating the entire drill string, and/or the drill bit may be rotated by a downhole motor which is included as a component of the drill string.

A typical form of downhole motor is a progressing cavity motor. A progressing cavity motor includes a power section comprising a stator and a rotor received within the stator. Drilling fluid is passed through the power section of the downhole motor in order to convert fluid energy into rotational energy of the rotor within the stator. The rotor is typically connected indirectly with the drill bit via a drive shaft.

In a progressing cavity motor, the rotor both rotates and nutates within the stator. As a result, the drive shaft is typically connected with the rotor via a drive connection such as a flex shaft or a constant velocity coupling, which accommodates and assimilates the nutation of the rotor so that the drive shaft and the drill bit rotate without nutating.

The rotor, the drive connection and the drive shaft provide a drive train which is typically received within a housing of the downhole motor. A distal end of the drive shaft may be connected directly with the drill bit (if the downhole motor is located at the distal end of the drill string), or may be connected with the drill bit via other components of the drill string (if the downhole motor is not located at the distal end of the drill string).

In a typical progressing cavity motor, a bearing section is typically provided axially between the drive connection and the drill bit, typically along the drive shaft. The purpose of the bearing section is to transfer forces between the housing and the drive train of the downhole motor, while enabling the drive train to rotate within the housing. The location of the bearing section (distal of the drive connection) ensures that the bearing section will not be subjected to undue wear due to nutation.

A typical bearing section may include one or more thrust bearings and one or more radial bearings. The thrust bearings transfer axial loads between the housing and the drive train. The radial bearings transfer radial loads between the housing and the drive train.

Axial loads experienced by a downhole motor may include on-bottom loads or off-bottom loads. On-bottom loads are typically compressive loads such as reactive forces exerted on the drill bit by the end of the borehole. Off-bottom loads are typically tensile loads and may result from drilling fluid passing through the motor (especially through the power section and through the drill bit) and/or from the weight of the motor and components of the drill string which are distal of the motor.

As the names suggest, on-bottom loads are typically most important during drilling when the drill bit is engaged with the end of the borehole, while off-bottom loads are typically most important when the drill string is raised above the end of the borehole so that the drill bit is not engaged with the end of the borehole.

Radial loads experienced by a downhole motor may be due to side loading on components of the motor or transverse vibration of components of the motor.

A downhole motor therefore typically includes in the bearing section one or more "on-bottom" thrust bearings, one or more "off-bottom" thrust bearings, and one or more radial bearings.

Locating all of these bearings in the bearing section, and locating the bearing section below the drive connection may result in a relatively long distance between the drive connection and the distal end of the downhole motor. This long distance is generally undesirable for several reasons.

First, a relatively long distance between the drive connection and the distal end of the motor results in a relatively long distance of the drive train between the power section and the drill bit. This relatively long distance can result in earlier failure of a downhole motor in comparison with a downhole motor which has a relatively short distance between the power section and the drill bit, due to the effects of torque and torsion on the drive train.

Second, bent downhole motors may be used for directional drilling, since the drilling direction can be controlled by controlling the orientation of the bend if the drill bit is rotated only by the motor. The bend in a bent downhole motor is typically located adjacent to the drive connection. As a result, a relatively long distance between the drive connection and the distal end of the motor provides a relatively long "bend to bit" distance. A relatively long bend to bit distance is disadvantageous for directional drilling because a longer bend is inherently less stiff than a shorter bend, with the result that a bent downhole motor with a relatively short bend to bit distance tends to be able to provide a larger "build angle" than a bent downhole motor with a relatively long bend to bit distance.

Third, bent downhole motors may be used for non-directional drilling by rotating the drill string in addition to or in substitution for rotating the drill bit with the motor. Rotation of the drill string rotates the motor, which results in rotation of the bend in the motor. The longer the bend to bit distance of the bent downhole motor, the greater the side loads and bending moments which are exerted on the motor during non-directional drilling. These side loads and bending moments may contribute to failure of the motor. In addition, the longer the bend to bit distance of the bent downhole motor, the larger the diameter of the borehole which will be drilled by the drill string. Although a large diameter borehole may be desirable in some circumstances, the use of a bent downhole motor with a relatively long bend to bit distance for non-directional drilling may be relatively inefficient in most circumstances.

As a result of the disadvantages associated with a relatively long distance between the drive connection and the distal end of a downhole motor, it would be desirable to take steps in the design and configuration of downhole motors to reduce this distance.

One opportunity for reducing the distance between the drive connection and the distal end of a downhole motor is provided by the bearing section of the motor. As one example, by moving some components of a typical bearing section away from the conventional position distal of the drive connection, the components of the bearing section can be distributed along the length of the motor. As a second example, by decoupling some or all of the loads which are imposed on the motor, such loads may be separated and apportioned amongst components of the bearing section, and the size (and length) of such components can potentially be reduced.

Some prior art approaches to downhole motors with non-conventional bearing arrangements are found in U.S. Pat. No.

6,629,571 (Downie), U.S. Pat. No. 7,416,034 (Downie et al), U.S. Pat. No. 7,802,638 (Downie et al), and U.S. Patent Application Publication No. US 2011/0147091 (Bullin).

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

In this document, "proximal" means located relatively toward an intended "uphole" end, "upper" end and/or "surface" end of the downhole motor assembly and/or a drill string as a point of origin.

In this document, "distal" means located relatively away from an intended "uphole" end, "upper" end and/or "surface" end of the downhole motor assembly and/or a drill string as a point of origin.

In this document, "fluid" means drilling fluid, water or any other type of fluid which may be circulated through a drill string.

In this document, "extending longitudinally" and "located longitudinally between" means direction or position relative to a longitudinal axis of the downhole motor assembly.

In this document, "arranged between" in the context of a bearing means interposed between relatively rotating components of the downhole motor assembly, even if one or more components of the bearing are comprised of and/or are integral with the relatively rotating components.

The present invention is directed at a downhole motor assembly in which one or more bearings are located proximal of the power section. The present invention is also directed at a downhole motor assembly in which some or all loads imposed on the motor are decoupled in order to separate and apportion such loads amongst two or more bearings.

In some embodiments, the loads which are decoupled may be axial loads. In some embodiments, the decoupling of axial loads may facilitate configuring separate thrust bearings as "off-bottom" thrust bearings and "on-bottom" thrust bearings respectively.

In an exemplary aspect, the invention is a downhole motor assembly comprising:

(a) a housing extending longitudinally between a proximal assembly end of the motor assembly and a distal assembly end of the motor assembly;
(b) a power section contained within the housing, wherein the power section is comprised of a stator and a rotor received within the stator, and wherein the rotor has a proximal rotor end and a distal rotor end;
(c) a proximal drive assembly connected with the proximal rotor end, for rotation with the rotor;
(d) a distal drive assembly connected with the distal rotor end, for rotation with the rotor;
(e) a proximal thrust bearing arranged between the housing and the proximal drive assembly, for transferring axial loads between the housing and the proximal drive assembly;
(f) a distal thrust bearing arranged between the housing and the distal drive assembly, for transferring axial loads between the housing and the distal drive assembly; and
(g) an axial load decoupling device in the distal drive assembly located longitudinally between the distal rotor end and the distal thrust bearing, for separating axial loads imposed on the proximal thrust bearing from axial loads imposed on the distal thrust bearing.

In some embodiments, the housing may be constructed as a single housing component. In some embodiments, the housing may be comprised of a plurality of housing components temporarily or permanently connected together. In some embodiments, the proximal assembly end and/or the distal assembly end of the housing may be configured to connect with a drill string.

The power section may be comprised of any type of rotary power section. In some embodiments, the power section may be powered by fluid passing through the power section. In some embodiments, the power section may be powered by electricity. In some embodiments, the power section may be powered by some source of power other than fluid energy or electricity.

In some embodiments, the power section may be comprised of a fluid driven turbine. In some embodiments, the power section may be comprised of a fluid driven progressing cavity device, such as a Moineau type apparatus.

The proximal drive assembly may be comprised of any structure, device or apparatus which is capable of being rotatably connected with the rotor and which can accommodate the proximal thrust bearing.

In some embodiments, the proximal drive assembly may be comprised of a proximal drive connection for accommodating or assimilating a nutating movement of the rotor. The proximal drive connection may be comprised of any suitable structure, device or apparatus. In some embodiments, the proximal drive connection may be comprised of a flex shaft. In some embodiments, the proximal drive connection may be comprised of a constant velocity coupling.

In some embodiments, the proximal drive assembly may be comprised of a proximal shaft. In some embodiments, the proximal shaft may be comprised of a single shaft component. In some embodiments, the proximal shaft may be comprised of a plurality of shaft components temporarily or permanently connected together. In some embodiments, the proximal thrust bearing may be arranged between the housing and the proximal shaft.

In some embodiments, the proximal drive connection may be located longitudinally between the proximal rotor end and the proximal shaft. The proximal drive connection may be directly or indirectly connected with the proximal shaft in any suitable manner. In some embodiments, the proximal shaft may be integrally formed with the proximal drive connection. In some embodiments, a proximal end of the proximal shaft may be configured to connect with structures, devices or apparatus associated with a drill string so that such structures, devices or apparatus rotate with the rotor.

The distal drive assembly may be comprised of any structure, device or apparatus which is capable of being rotatably connected with the rotor and which can accommodate the distal thrust bearing.

In some embodiments, the distal drive assembly may be comprised of a distal drive connection for accommodating or assimilating a nutating movement of the rotor. The distal drive connection may be comprised of any suitable structure, device or apparatus. In some embodiments, the distal drive connection may be comprised of a flex shaft. In some embodiments, the distal drive connection may be comprised of a constant velocity coupling.

In some embodiments, the distal drive assembly may be comprised of a distal shaft. In some embodiments, the distal shaft may be comprised of a single shaft component. In some embodiments, the distal shaft may be comprised of a plurality of shaft components temporarily or permanently connected together. In some embodiments, the distal thrust bearing may be arranged between the housing and the distal shaft.

In some embodiments, the distal drive connection may be located longitudinally between the distal rotor end and the distal shaft. The distal drive connection may be directly or indirectly connected with the distal shaft in any suitable manner. In some embodiments, the distal shaft may be integrally formed with the distal drive connection. In some embodiments, a distal end of the distal shaft may be configured to connect with structures, devices or apparatus associated with a drill string so that such structures, devices or apparatus rotate with the rotor.

The proximal thrust bearing may be comprised of any structure, device or apparatus which is capable of supporting the axial loads which are to be imposed upon the proximal thrust bearing. In some embodiments, the proximal thrust bearing may be comprised of one or more plain bearings. In some embodiments, the proximal thrust bearing may be comprised of one or more rolling element type bearings such as ball bearings or roller bearings.

The distal thrust bearing may be comprised of any structure, device or apparatus which is capable of supporting the axial loads which are to be imposed upon the distal thrust bearing. In some embodiments, the distal thrust bearing may be comprised of one or more plain bearings. In some embodiments, the distal thrust bearing may be comprised of one or more rolling element type bearings such as ball bearings or roller bearings.

In some embodiments, the motor assembly may be further comprised of one or more radial bearings.

In some embodiments, one or more radial bearings may be arranged between the housing and the distal drive assembly, for transferring radial loads between the housing and the distal drive assembly. In some embodiments, one or more radial bearings may be located longitudinally between the distal drive connection and the distal thrust bearing.

In some embodiments, one or more radial bearings may be provided between the housing and the proximal drive assembly, for transferring radial loads between the housing and the proximal drive assembly. In some embodiments, one or more radial bearings may be provided between the proximal drive connection and the proximal thrust bearing.

The axial load decoupling device may be comprised of any structure, device or apparatus which is capable of separating axial loads imposed on the proximal thrust bearing from axial loads imposed on the distal thrust bearing, while transferring torque to enable the distal drive assembly to rotate with the rotor.

The axial load decoupling device may be incorporated into the distal drive assembly in any suitable manner. In some embodiments, the axial load decoupling device may be integrally formed with the distal drive assembly. In some embodiments, the axial load decoupling device may be incorporated into the distal drive assembly by welded connections. In some embodiments, the axial load decoupling device may be incorporated into the distal drive assembly by threaded connections.

The axial load decoupling device may be located longitudinally at any suitable position between the distal rotor end and the distal thrust bearing. In some embodiments, the axial load decoupling device may be located longitudinally between the distal drive connection and the distal thrust bearing. In some embodiments, the axial load decoupling device may be located longitudinally between the distal rotor end and the distal drive connection.

In some embodiments, the axial load decoupling device may be comprised of a spline connection. In some embodiments, the spline connection may be comprised of a male spline connection and a complementary female spline connection, wherein the male spline connection is received within the female spline connection such that the male spline connection and the female spline connection are capable of relative axial movement while rotating together.

In some embodiments, one of the male spline connection and the female spline connection may be connected directly or indirectly with the distal drive connection, and the other of the male spline connection and the female spline connection may be connected directly or indirectly with the distal shaft.

In some embodiments, one of the male spline connection and the female spline connection may be connected directly or indirectly with the distal rotor end, and the other of the male spline connection and the female spline connection may be connected directly or indirectly with the distal drive connection.

The rotor, the proximal drive assembly and the distal drive assembly comprise a drive train of the downhole motor assembly. In some embodiments, a drill bit may be directly or indirectly connected with the distal drive assembly so that the drill bit may be rotated by the drive train. In some embodiments, other structures, devices or apparatus may be connected directly or indirectly with the proximal drive assembly and/or the distal drive assembly, so that such structures, devices or apparatus may be rotated by the drive train.

The axial load decoupling device is located longitudinally between the proximal thrust bearing and the distal thrust bearing and separates the drive train into a proximal drive train and a distal drive train, so that axial loads imposed on the proximal thrust bearing are separated from axial loads imposed on the distal thrust bearing.

Some or all axial loads imposed on the proximal drive train are transferred between the housing and the proximal drive train by the proximal thrust bearing. Some or all axial loads imposed on the distal drive train are transferred between the housing and the distal drive train by the distal thrust bearing.

In some embodiments, the proximal thrust bearing may be configured primarily or exclusively as an off-bottom thrust bearing, since the proximal thrust bearing will be exposed to significantly greater off-bottom axial loads than on-bottom axial loads. In some embodiments, the distal thrust bearing may be configured primarily or exclusively as an on-bottom thrust bearing, since the distal thrust bearing will be exposed to significantly greater on-bottom axial loads than off-bottom axial loads.

In some embodiments, the downhole motor assembly may be further comprised of a retainer bearing arranged between the housing and the distal drive train, for rotatably supporting the distal drive train in the housing. In some embodiments, off-bottom axial loads imposed on the distal drive train may be transferred between the housing and the distal drive train by the retainer bearing.

The retainer bearing may be comprised of any suitable structure, device or apparatus which is capable of retaining and rotatably supporting the distal drive train in the housing. In some embodiments, the retainer bearing may be comprised of one or more rolling element type bearings such as ball bearings or roller bearings.

BRIEF DESCRIPTION OF DRAWINGS

Embodiments of the invention will now be described with reference to the accompanying drawings, in which.

DETAILED DESCRIPTION

Referring to FIGS. 1-4, embodiments of a downhole motor assembly according to the invention are depicted.

Figure 1A:
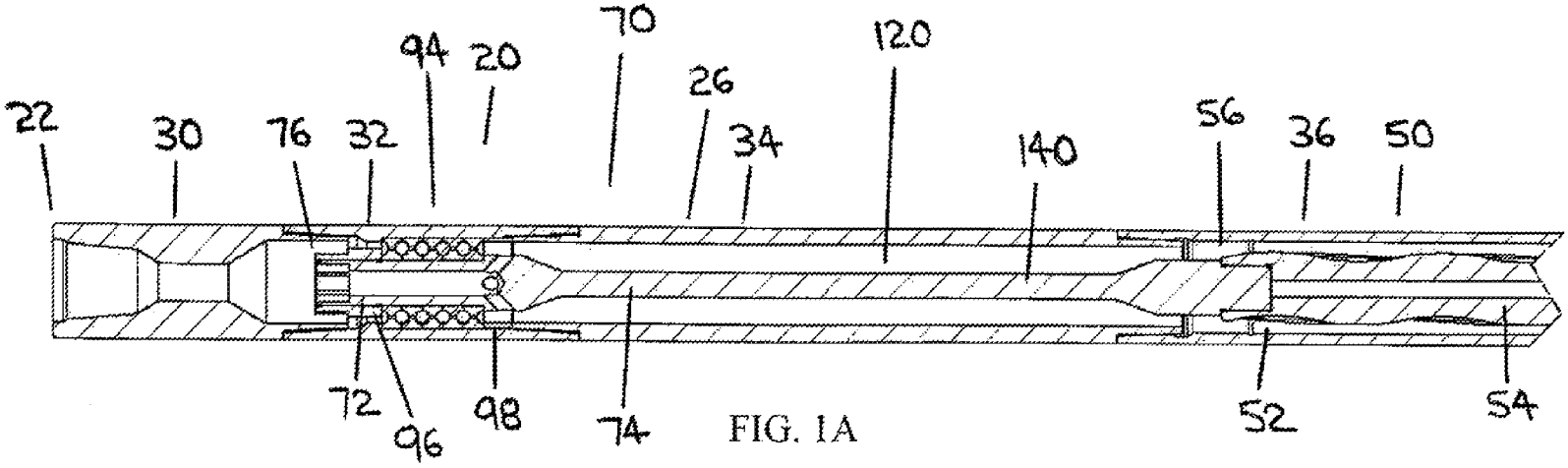
FIG. 1A and FIG. 1B is a longitudinal section assembly view of a first embodiment of a downhole motor assembly according to the invention in which the proximal drive connection is comprised of a flex shaft, with FIG. 1B being a continuation of FIG. 1A.
Figure 1B:
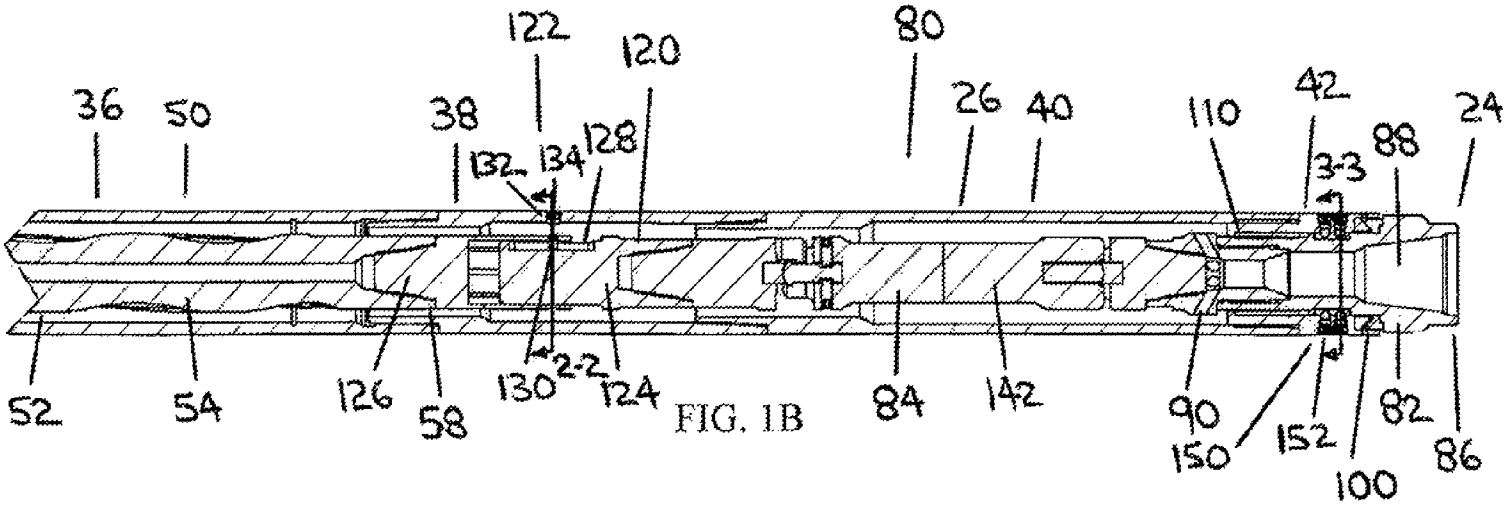

FIG. 1A and FIG. 1B are together a longitudinal section assembly view of a first embodiment of the downhole motor assembly, in which the proximal drive connection is comprised of a flex shaft. FIG. 1A depicts the proximal end of the downhole motor assembly and FIG. 1B depicts the distal end of the downhole motor assembly. A portion of the power section of the downhole motor assembly has been omitted between FIG. 1A and FIG. 1B.

Figure 2:
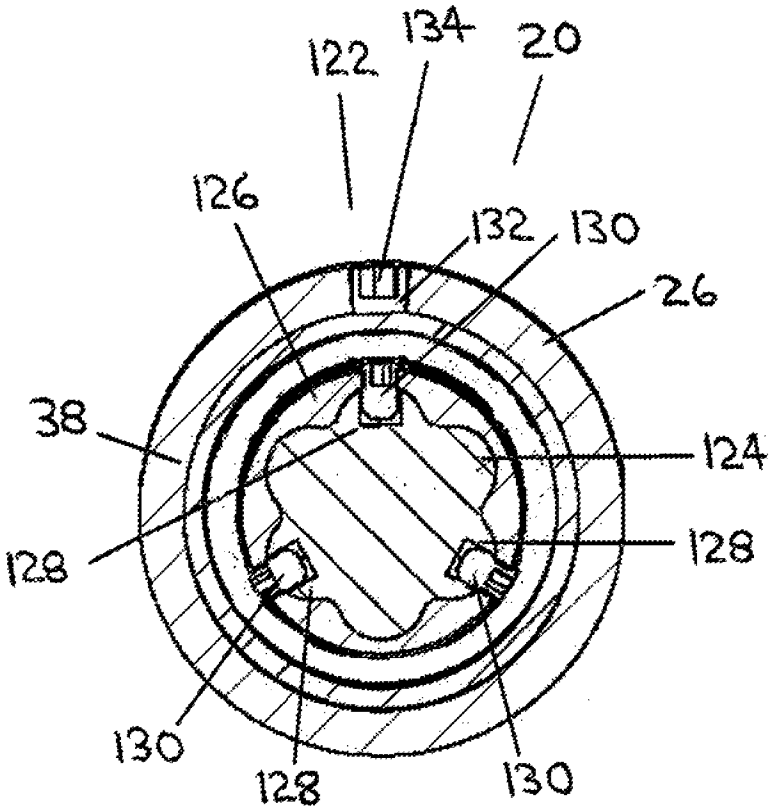
FIG. 2 is a transverse section view of the axial load decoupling device of the first embodiment of downhole motor assembly of FIG. 1, taken along line 2-2 in FIG. 1.

FIG. 2 is a transverse section view of the axial load decoupling device of the first embodiment of downhole motor assembly, in which the axial load decoupling device is comprised of a spline connection.

Figure 3:
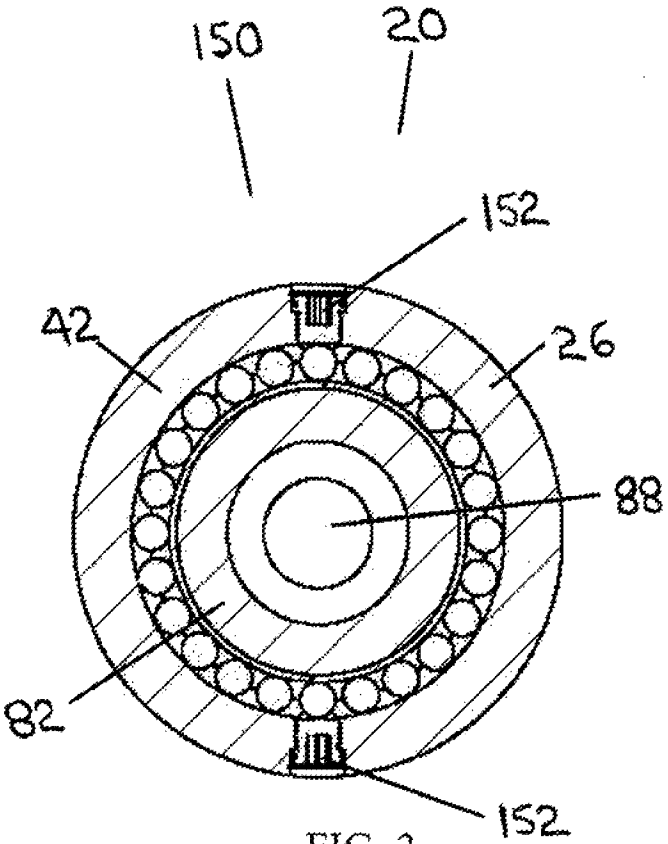
FIG. 3 is a transverse section view of the retainer bearing of the first embodiment of downhole motor assembly of FIG. 1, taken along line 3-3 in FIG. 1.

FIG. 3 is a transverse section view of the retainer bearing of the first embodiment of downhole motor assembly, in which the retainer bearing is comprised of two rolling element bearings.

Figure 4A:
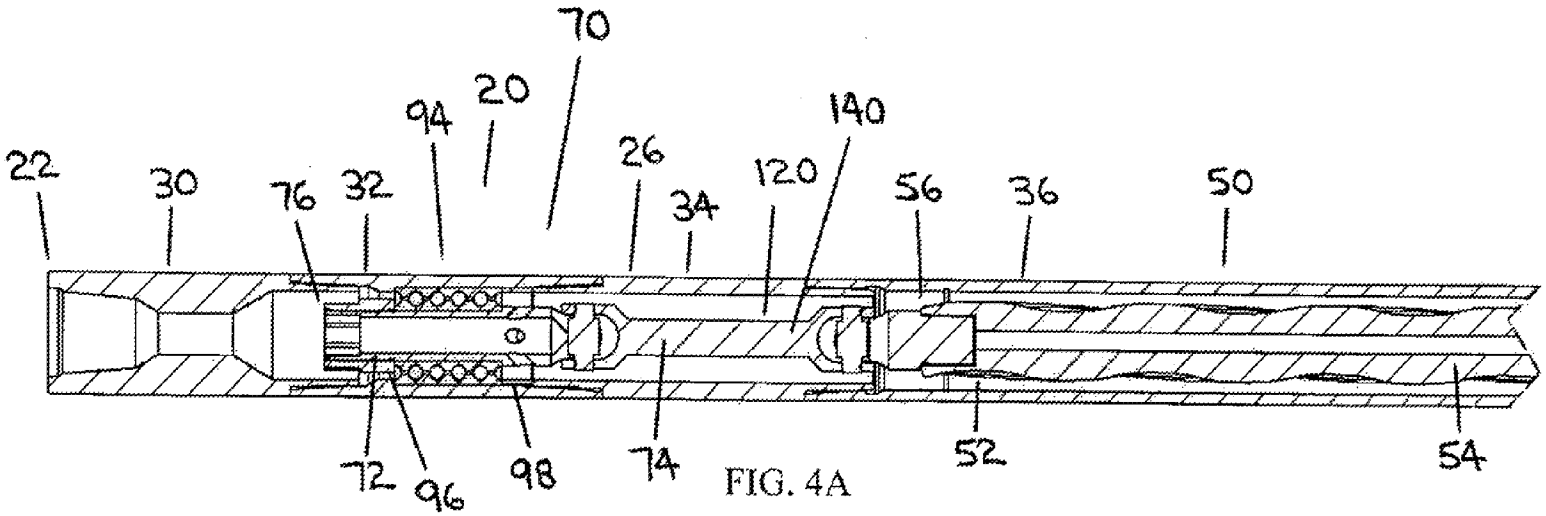
FIG. 4A and FIG. 4B is a longitudinal section assembly view of a second embodiment of a downhole motor assembly according to the invention in which the proximal drive connection is comprised of a constant velocity coupling, with FIG. 4B being a continuation of FIG. 4A.
Figure 4B:
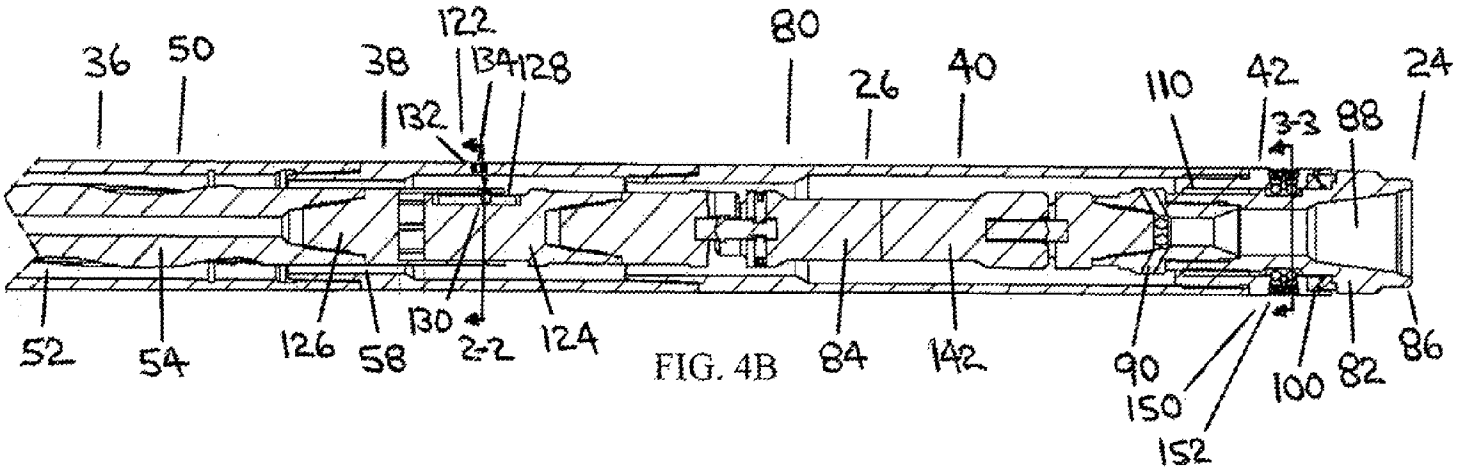

FIG. 4A and FIG. 4B are together a longitudinal section assembly view of a second embodiment of downhole motor assembly in which the proximal drive connection is comprised of a constant velocity coupling. FIG. 4A depicts the proximal end of the downhole motor assembly and FIG. 4B depicts the distal end of the downhole motor assembly. A portion of the power section of the downhole motor assembly has been omitted between FIG. 4A and FIG. 4B.

The first embodiment of downhole motor assembly and the second embodiment of downhole motor assembly depicted in FIGS. 1-4 represent two exemplary embodiments of the invention. Many other embodiments are possible within the scope of the invention as described herein.

In the description of the two exemplary embodiments which follows, features of the first embodiment of downhole motor assembly which are equivalent or identical to features of the second embodiment of downhole motor assembly are assigned the same reference number.

Referring to FIG. 1, a first embodiment of a downhole motor assembly (20) has a proximal assembly end (22) and a distal assembly end (24). A housing (26) extends longitudinally between the proximal assembly end (22) and the distal assembly end (24).

In the embodiment of FIG. 1, the housing (26) is comprised of a plurality of a plurality of housing components connected together with threaded connections. From the proximal assembly end (22) to the distal assembly end (24), the housing (26) is comprised of an upper sub (30), a proximal bearing housing (32), a proximal drive connection housing (34), a power section housing (36), an axial load decoupling device housing (38), a distal drive connection housing (40), and a distal bearing housing (42).

A power section (50) is contained within the housing (26). In the embodiment of FIG. 1, the power section (50) is comprised of a Moineau type progressing cavity apparatus. The power section (50) is comprised of a stator (52) and a rotor (54). The rotor (54) is received within the stator (52). The rotor has a proximal rotor end (56) and a distal rotor end (58).

A proximal drive assembly (70) is connected with the proximal rotor end (56), for rotation with the rotor (54). In the embodiment of FIG. 1, the proximal drive assembly (70) is comprised of a proximal shaft (72) and a proximal drive connection (74). The proximal drive connection (74) is located longitudinally between the proximal rotor end (56) and the proximal shaft (72). In the embodiment of FIG. 1, the proximal drive connection (74) is comprised of a flex shaft which is threadably connected with the proximal rotor end (56). In the embodiment of FIG. 1, the proximal shaft (72) is formed integrally with the flex shaft. In other embodiments, the proximal shaft (72) and the proximal drive connection (74) may be comprised of separate components, and the proximal shaft (72) may be comprised of one or more components.

A proximal end (76) of the proximal shaft (72) may optionally be configured to connect with structures, devices or apparatus (not shown) so that such structures, devices or apparatus rotate with the rotor (54).

A distal drive assembly (80) is connected with the distal rotor end (58), for rotation with the rotor (54). In the embodiment of FIG. 1, the distal drive assembly (80) is comprised of a distal shaft (82) and a distal drive connection (84). The distal drive connection (84) is located longitudinally between the distal rotor end (58) and the distal shaft (82). In the embodiment of FIG. 1, the distal drive connection (84) is comprised of a constant velocity coupling which is threadably connected with both the distal rotor end (58) and the distal shaft (82). In the embodiment of FIG. 1, the distal shaft (82) is comprised of two shaft components which are threadably connected together. In other embodiments, the distal shaft (82) may be comprised of a single component, or may be comprised of more than two components.

In the embodiment of FIG. 1, a distal end (86) of the distal shaft (82) is configured to connect with a drill bit (not shown) or with some other structure, device or apparatus (not shown) so that the drill bit or other structure, device or apparatus rotates with the rotor (54).

In the embodiment of FIG. 1, the distal end (86) of the distal shaft (82) defines a bore (88) and the distal shaft defines ports (90) which communicate with the bore (88) so that drilling fluid may be supplied to the drill bit.

A proximal thrust bearing (94) is arranged between the proximal bearing housing (32) and the proximal shaft (72), for transferring axial loads between the proximal bearing housing (32) and the proximal shaft (72). In the embodiment of FIG. 1, the proximal thrust bearing (94) is comprised of a stack comprising a plurality of rolling element type bearings. The proximal thrust bearing (94) is retained between a retaining nut (96) which is threadably connected with the proximal end (76) of the proximal shaft (72) and a shoulder on the proximal shaft (72), and between a shoulder on the proximal bearing housing (32) and a shim (98) which abuts the proximal end of the proximal drive connection housing (34).

A distal thrust bearing (100) is arranged between the distal bearing housing (42) and the distal shaft (82), for transferring axial loads between the distal bearing housing (42) and the distal shaft (82). In the embodiment of FIG. 1, the distal thrust bearing (100) is comprised of a tapered plain bearing comprising one tapered polycrystalline diamond (PDC) face and one tapered metal face. The distal thrust bearing (100) is retained between a shoulder on the distal bearing housing (42) and a shoulder on the distal shaft (82).

In the embodiment of FIG. 1, a radial bearing (110) is arranged between the distal bearing housing (42) and the distal shaft (82) such that the radial bearing (110) is located longitudinally between the distal drive connection (84) and the distal thrust bearing (100).

The rotor (54), the proximal drive assembly (70) and the distal drive assembly (80) comprise a drive train (120) of the downhole motor assembly (20).

An axial load decoupling device (I 22) is located longitudinally in the distal drive assembly (80) between the distal rotor end (58) and the distal thrust bearing (100). The purpose of the axial load decoupling device (122) is to decouple axial loads which are imposed upon the drive train (120) proximal and distal to the axial load decoupling device (122).

In the embodiment of FIG. 1, the axial load decoupling device (122) is more specifically located longitudinally between the distal rotor end (58) and the distal drive connection (84) so that the axial load decoupling device (122) is located longitudinally proximal to the distal drive connection (84). In other embodiments, the axial load decoupling device (122) may be located between the distal drive connection (84) and the distal thrust bearing (100) so that the axial load decoupling device (122) is located longitudinally distal to the distal drive connection (84), or at some other longitudinal location between the distal rotor end (58) and the distal thrust bearing (100).

Referring to FIG. 1 and FIG. 2, in the embodiment of FIG. 1, the axial load decoupling device (122) is comprised of a spline connection, which is capable of decoupling axial loads while transmitting torque through the drive train (120).

In the embodiment of FIG. 1, the spline connection is comprised of a male spline connection (124) and a complementary female spline connection (126). The male spline connection (124) is threadably connected with the distal rotor end (58). The female spline connection (126) is threadably connected with the distal drive connection (84).

In the embodiment of FIG. 1, the male spline connection (124) is comprised of three longitudinal grooves (128) in the exterior surface of the male spline connection (124). The three longitudinal grooves (128) are configured to accept complementary set screws (130) which are threaded into the female spline connection (126) after the spline connection has been assembled, in order to prevent the male spline connection from becoming disengaged from the female spline connection (126). The set screws (130) may be accessed through an aperture (132) in the axial force decoupling device housing (38) in order to facilitate assembly and disassembly of the spline connection. A plug (134) is threadably received in the aperture (132) to seal the aperture (132) except during assembly and disassembly of the spline connection.

The axial load decoupling device (122) separates the drive train (120) into a proximal drive train (140) and a distal drive train (142).

As a result of the decoupling of axial loads by the axial load decoupling device (122), the proximal drive train (140) is subjected primarily to "off-bottom" or tensile axial loads. These off-bottom axial loads may result from drilling fluid passing through the power section (50) and/or from the weight of components of the proximal drive train (140). The proximal drive train (140) may also be subjected to a relatively smaller magnitude of "on-bottom" or compressive axial loads if structures, devices or apparatus are connected with the proximal end (76) of the proximal shaft (72).

In the embodiment of FIG. 1, the proximal thrust bearing (94) is therefore configured as an off-bottom thrust bearing, since the magnitude of the off-bottom axial loads experienced by the proximal thrust bearing (94) will be greater than the magnitude of the on-bottom axial loads experienced by the proximal thrust bearing (94).

As a result of the decoupling of axial loads by the axial load decoupling device (122), the distal drive train (142) is subjected primarily to "on-bottom" or compressive axial loads. These on-bottom axial loads may be comprised of reactive forces exerted on the drill bit by the end of the borehole (not shown) during drilling. The distal drive train (142) will also be subjected to a relatively smaller magnitude of "off-bottom" or compressive axial loads resulting from drilling fluid passing through the drill bit, from the weight of components of the distal drive train (142), and/or from the weight of the drill bit or other structures, devices or apparatus which may be connected to the distal end (86) of the distal shaft (82).

In the embodiment of FIG. 1, the distal thrust bearing (100) is therefore configured as an on-bottom thrust bearing, since the magnitude of the on-bottom axial loads experienced by the distal thrust bearing (100) will be greater than the magnitude of the off-bottom axial loads experienced by the distal thrust bearing (100).

As a result of the decoupling by the axial load decoupling device (122) of the axial loads imposed upon the drive train (120), the distal drive train (142) is not supported in the housing (26) by the proximal thrust bearing (94). Consequently, in the embodiment of FIG. 1, the downhole motor assembly is further comprised of a retainer bearing (150) arranged between the distal bearing housing (42) and the distal shaft (82), for rotatably supporting the distal drive train (142) in the housing (26). The retainer bearing (150) prevents the distal drive train (142) from becoming disengaged from the housing (26), and transfers off-bottom axial loads between the distal bearing housing (42) and the distal shaft (82).

Referring to FIG. 1 and FIG. 3, in the embodiment of FIG. 1, the retainer bearing (150) is comprised of a stack of two rolling element type bearings. Two ball plugs (152) are provided in the distal bearing housing (42) for each of the two bearings to facilitate insertion and removal of the rolling elements and assembly and disassembly of the downhole motor assembly (20). The ball plugs (152) are provided with O-ring seals to inhibit debris from entering the retainer bearing (150).

In summary, in the embodiment of FIG. 1, off-bottom axial loads which are imposed upon the proximal drive train (140) are transferred between the proximal bearing housing (32) and the proximal drive train (140) by the proximal thrust bearing (94), on-bottom axial loads which are imposed upon the distal drive train (142) are transferred between the distal bearing housing (42) and the distal drive train (142) by the distal thrust bearing (100), off-bottom axial loads which are imposed upon the distal drive train (142) are transferred between the distal bearing housing (42) and the distal drive train (142) by the retainer bearing (150), and radial loads which are imposed upon the distal drive train (142) are transferred between the distal bearing housing (42) and the distal drive train (142) by the radial bearing (110).

By locating the proximal thrust bearing (94) proximal to the power section (50), and by decoupling the axial loads which are imposed upon the drive train (120) so that a significant portion of the off-bottom axial loads are experienced by the proximal thrust bearing (94), the overall size and length of the bearings which are included in the downhole motor assembly (20) distal of the distal drive connection (84) can be reduced in comparison with conventional bearing configurations in downhole motors.

Referring to FIG. 4, the second embodiment of downhole motor assembly (20) depicted in FIG. 4 is substantially identical to the first embodiment of downhole motor assembly (20) depicted in FIGS. 1-3. The essential difference between the first embodiment and the second embodiment of downhole motor assembly (20) is the configuration of the proximal drive assembly (70).

As described above, the proximal drive assembly (70) of the first embodiment of FIGS. 1-3 is comprised of a proximal shaft (72) and a proximal drive connection (74), wherein the proximal drive connection is comprised of a flex shaft and the proximal shaft (72) is integrally formed with the flex shaft.

In the second embodiment of FIG. 4, the proximal drive assembly (70) is also comprised of a proximal shaft (72) and a proximal drive connection (74). In the second embodiment of FIG. 4, however, the proximal drive connection (74) is comprised of a constant velocity coupling and the proximal shaft (72) is threadably connected with the constant velocity coupling.

The second embodiment of FIG. 4 may be used in applications in which the proximal drive train (140) may be subjected to relatively large magnitude axial loads, particularly relatively large "off-bottom" or tensile axial loads. In such circumstances a constant velocity coupling and a separate proximal shaft (72) may tend to be more robust than a flex shaft and an integral proximal shaft (72).

In respects other than the proximal drive assembly (70), the above description of the first embodiment of downhole motor assembly (20) of FIGS. 1-3 is generally applicable to the second embodiment of downhole motor assembly (20) of FIG. 4.

In use, the downhole motor assembly (20) of the invention may be incorporated into a drill string (not shown) in the same manner as conventional or prior art downhole motor assemblies. The drill string may be comprised of joints of drill pipe, coiled tubing and/or any other tools or components or combinations of tools or components of the type which may be incorporated into a drill string.

In some configurations, the proximal assembly end (22) may be connected with a drill string (not shown) and a drill bit (not shown) may be connected with the distal end (86) of the distal shaft (82). Such configurations may represent a "typical" simple application for a downhole motor.

In some configurations, a structure, device or apparatus (not shown) may be connected with the proximal end (76) of the proximal shaft (72) so that the structure, device or apparatus is rotated by the rotor (54). As non-limiting examples, a valve (not shown) may be connected with the proximal shaft (72) so that the valve is actuated as the rotor (54) turns in order to produce oscillations in flow and/or pressure of drilling fluid through the downhole motor assembly (20), or a pump (not shown) may be connected with the proximal shaft (72) in order to drive the pump to provide hydraulic actuation of tools or components such as stabilizer or steering blades (not shown).

In some configurations, the distal bearing housing (42) may be connected with a drill string (not shown) so that the downhole drilling motor (20) is not located at the distal end of the drill string. In such configurations, the distal shaft (82) may be connected with an extension shaft (not shown), and a drill bit (not shown) may be connected directly or indirectly with the extension shaft. In some such configurations, the drill string may be comprised of a steering tool (not shown) such as a rotary steerable steering tool so that the drilling direction can be controlled by the steering tool when the drill bit is rotated by the rotor (54).

In some configurations, the distal end (86) of the distal shaft (82) may be connected with a drill string (not shown) so that the drill string is rotated by the rotor (54). In such configurations, rotation of the rotor (54) results in rotation of the drill string distal of the downhole motor assembly (20).

The above configurations are exemplary only, and other configurations of drill string using the downhole motor assembly (20) of the invention may be implemented.

As with conventional or prior art downhole motor assemblies, the downhole motor assembly (20) of the invention may optionally be provided with a bend to facilitate directional drilling. The downhole motor assembly (20) of the invention potentially facilitates a relatively shorter bend to bit distance than is possible with a conventional downhole motor assembly in which all of the bearings are located in a bearing section distal of the distal drive connection.

Another potential benefit of the downhole motor assembly (20) of the invention is that the proximal thrust bearing (94) may eliminate the need for a separate "rotor catch" of the type which may be attached to the proximal rotor end (56) in a conventional downhole motor assembly in order to prevent the rotor (54) from falling through the downhole motor assembly (20) if a portion of the housing (26) below the power section (50) "twists off", since the rotor (54) in the downhole motor assembly (20) of the invention is supported by the proximal thrust bearing (94).

In the two embodiments of the downhole motor assembly (20) of FIGS. 1-4, the downhole motor assembly (20) is configured as a "mud-lubricated" apparatus. In other words, the bearings (94, 100, 110, 150) are cooled and lubricated by drilling fluid (not shown) passing through the downhole drilling assembly (20). In other embodiments, the downhole motor assembly (20) may be configured as an "oil-lubricated" apparatus in which the bearings (94, 100, 110, 150) are cooled and lubricated by oil, and in which seals are provided to isolate the bearings (94, 100, 110, 150) in one or more oil chambers.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive privilege or property is claimed are defined as follows:

1. A downhole motor assembly comprising:

(a) a housing extending longitudinally between a proximal assembly end of the motor assembly and a distal assembly end of the motor assembly;

(b) a power section contained within the housing, wherein the power section is comprised of a stator and a rotor received within the stator, and wherein the rotor has a proximal rotor end and a distal rotor end;

(c) a proximal drive assembly connected with the proximal rotor end, for rotation with the rotor, wherein the proximal drive assembly is comprised of a proximal shaft and a proximal drive connection located longitudinally between the proximal rotor end and the proximal shaft, and wherein the proximal drive connection assimilates a nutating movement of the rotor;

(d) a distal drive assembly connected with the distal rotor end, for rotation with the rotor;

(e) a proximal thrust bearing arranged between the housing and the proximal drive assembly, for transferring axial loads between the housing and the proximal drive assembly;

(f) a distal thrust bearing arranged between the housing and the distal drive assembly, for transferring axial loads between the housing and the distal drive assembly; and (g) an axial load decoupling device in the distal drive assembly located longitudinally between the distal rotor end and the distal thrust bearing, for separating axial loads imposed on the proximal thrust bearing from axial loads imposed on the distal thrust bearing.

2. The motor assembly as claimed in claim 1 wherein the proximal drive connection is comprised of a flex shaft.

3. The motor assembly as claimed in claim 1 wherein the proximal drive connection is comprised of a constant velocity coupling.

4. The motor assembly as claimed in claim 1 wherein the proximal thrust bearing is arranged between the housing and the proximal shaft.

5. The motor assembly as claimed in claim 4 wherein the distal drive assembly is comprised of a distal shaft and a distal drive connection located longitudinally between the distal rotor end and the distal shaft, and wherein the distal thrust bearing is arranged between the housing and the distal shaft.

6. The motor assembly as claimed in claim 5 wherein the rotor, the proximal drive assembly and the distal drive assembly comprise a drive train and wherein the axial load decoupling device separates the drive train into a proximal drive train and a distal drive train, further comprising a retainer bearing arranged between the housing and the distal drive train, for rotatably supporting the distal drive train in the housing.

7. The motor assembly as claimed in claim 6 wherein the axial load decoupling device is located longitudinally between the distal rotor end and the distal drive connection.

8. The motor assembly as claimed in claim 7 wherein the proximal thrust bearing is configured as an off-bottom thrust bearing and wherein the distal thrust bearing is configured as an on-bottom thrust bearing.

9. The motor assembly as claimed in claim 7 wherein the axial load decoupling device is comprised of a spline connection.

10. The motor assembly as claimed in claim 7 wherein the proximal drive connection is comprised of a flex shaft.

11. The motor assembly as claimed in claim 7 wherein the proximal drive connection is comprised of a constant velocity coupling.

12. The motor assembly as claimed in claim 7 wherein the distal connection is comprised of a constant velocity coupling.

13. The motor assembly as claimed in claim 7, further comprising a radial bearing arranged between the housing and the distal shaft, for transferring radial loads between the housing and the distal drive assembly.

14. The motor assembly as claimed in claim 13 wherein the radial bearing is located longitudinally between the distal drive connection and the distal thrust bearing.

15. The motor assembly as claimed in claim 1 wherein the distal drive assembly is comprised of a distal shaft and a distal drive connection located longitudinally between the distal rotor end and the distal shaft.

16. The motor assembly as claimed in claim 15 wherein the distal drive connection is comprised of a constant velocity coupling.

17. The motor assembly as claimed in claim 15 wherein the distal thrust bearing is arranged between the housing and the distal shaft.

18. The motor assembly as claimed in claim 17, further comprising a radial bearing arranged between the housing and the distal shaft, for transferring radial loads between the housing and the distal drive assembly.

19. The motor assembly as claimed in claim 18, wherein the radial bearing is located longitudinally between the distal drive connection and the distal thrust bearing.

20. The motor assembly as claimed in claim 15 wherein the axial load decoupling device is located longitudinally between the distal rotor end and the distal drive connection.

21. The motor assembly as claimed in claim 20 wherein the axial load decoupling device is comprised of a spline connection.

22. The motor assembly as claimed in claim 20 wherein the rotor, the proximal drive assembly and the distal drive assembly comprise a drive train, wherein the axial load decoupling device separates the drive train into a proximal drive train and a distal drive train, further comprising a retainer bearing arranged between the housing and the distal drive train, for rotatably supporting the distal drive train in the housing.

23. The motor assembly as claimed in claim 22 wherein the proximal thrust bearing is configured as an off-bottom thrust bearing and wherein the distal thrust bearing is configured as an on-bottom thrust bearing.

24. The motor assembly as claimed in claim 1 wherein the rotor, the proximal drive assembly and the distal drive assembly comprise a drive train and wherein the axial load decoupling device separates the drive train into a proximal drive train and a distal drive train, further comprising a retainer bearing arranged between the housing and the distal drive train, for rotatably supporting the distal drive train in the housing.

25. The motor assembly as claimed in claim 24 wherein the proximal thrust bearing is configured as an off-bottom thrust bearing and wherein the distal thrust bearing is configured as an on-bottom thrust bearing.

* * * * *